United States Patent [19]

Johnson

[11] Patent Number: 4,741,465

[45] Date of Patent: May 3, 1988

[54] CONCEALMENT POCKET HOLSTER

[76] Inventor: Wayne A. Johnson, 5941 Skyline Dr., Corpus Christi, Tex. 78408

[21] Appl. No.: 5,116

[22] Filed: Jan. 20, 1987

Related U.S. Application Data

[63] Continuation-in-part of Ser. No. 818,478, Jan. 13, 1986, abandoned.

[51] Int. Cl.[4] ..... F41C 33/02

[52] U.S. Cl. ..... 224/230; 224/911

[58] Field of Search ..... 224/198, 236, 243, 911, 224/251, 253; 2/247, 249, 250, 253

[56] References Cited

U.S. PATENT DOCUMENTS

| | | | |
|---|---|---|---|
| 309,292 | 12/1884 | Browne | 224/230 |
| 1,120,190 | 12/1914 | Gaskill | 224/230 |
| 1,191,339 | 7/1916 | Noye | 224/230 |
| 1,886,718 | 11/1932 | Noel | 224/230 |
| 1,887,780 | 11/1932 | Noel | 224/230 |
| 2,594,614 | 4/1952 | Behnke | 224/230 X |
| 4,122,987 | 10/1978 | Russell | 224/230 |
| 4,235,356 | 11/1980 | Atchisson | 224/911 X |
| 4,262,832 | 4/1981 | Perkins | 224/230 X |
| 4,416,315 | 11/1983 | Foley | 224/230 X |

FOREIGN PATENT DOCUMENTS

| | | | |
|---|---|---|---|
| 178079 | 7/1917 | Canada | 224/230 |

*Primary Examiner*—Henry J. Recla
*Assistant Examiner*—Robert Petrik

[57] ABSTRACT

This invention relates to a special handgun holster that is capable of concealing a handgun on a person who is wearing only walking shorts and no shirt. Concealing the handgun is accomplished by enveloping the grip end of the handgun inside a pouch that appears to be a large truckers wallet protruding slightly from the pants pocket or walking shorts pocket and camouflaging the muzzle end of the handgun in the lower part of the front pants pocket or walking shorts pocket by adding a block of material to break up the outline of the handgun. In addition a metal bar is placed through the pouch to keep the handgun securely in the pants or walking shorts pocket and to position the pouch around the handgun grip.

2 Claims, 3 Drawing Sheets

CONCEALMENT POCKET HOLSTER

A continuation in part of Ser. No. 06/818-478, New Ser. No. 005116, new filing date 1-20-87.

BACKGROUND OF THE INVENTION

This invention is related to devices for carrying a handgun concealed on a person's body, and especially to a holster for carrying a handgun concealed in a pants pocket.

Law enforcement officers and other persons who are authorized or licensed to carry a concealed weapon often wish to carry a handgun completely concealed on a person's body. The best complete concealment concept means that the handgun is still completely concealed after a person removes any coat or shirt or any other outer garment.

Holsters designed for carrying handguns partially or completely concealed are not new, and many types of handgun concealment holsters are well known. These ordinary handgun concealment holsters are often less than satisfactory in many situations. For example, the usual shoulder holster is readily visible whenever a wearer removes or unbuttons a coat or jacket.

Many types of handgun concealment holsters are attached inside or outside of the wearer's belt to be concealed by the wearer's coat. Handguns carried in belt mounted holsters of pryor art are normally visible when a coat is not worn, thus do not conceal the handgun for informal dress occasions.

Another example of handgun concealment holster is the ankle holster. The ankle holster offers almost complete concealment of the handgun by attaching it to the ankle by a strap around the ankle and concealment by the pants leg. Ankle holsters are almost always very uncomfortable for most persons and obviously out of easy reach on most occasions.

Another type of handgun concealment holster is strapped directly to the wearer's body sometimes behind a shirt or brassiere. This offers good concealment but leaves the handgun far too difficult to reach in an emergency situation.

One more type of concealment holster is literally fastened to the wearer's shirt tail, but then it must be behind or below the pants belt and inside the pants. This works fine for a very small handgun but would show a very large bulge if used with even a medium sized handgun.

All of the aforementioned handgun concealment holsters require the wearer to wear at least a shirt and in the case of the shoulder holster a coat in addition except for the ankle holster which requires long pants legs and is clumsy to use.

SUMMARY OF THE INVENTION

This particular invention solves many of the problems still present in the prior art by presenting a handgun concealment holster which is designed to carry a handgun in a pants pocket and more particularly, totally hidden from view in either of the two front pants pockets. More particularly, this handgun concealment holster is comprised of two or more components in a special design to camouflage the shape and outline of the handgun in the pocket. A large handgun in a pants pocket must show a large bulge in the same pants pocket, but in this invention the large bulge is made to appear to be something other than a handgun, and more particularly, the large bulge of a trucker's wallet. In addition this invention causes the pants pocket to appear to contain a number of small articles in the bottom of the pocket instead of the large handgun. In particular, the upper component of this invention while in the pants pocket appears to be a trucker's wallet protruding from the pants pocket, but in reality is a cover for the handgun grip and serves to secure the handgun in the pants pocket. In more detail this upper component is secured in the pants pocket by a metal bar. This metal bar is bent in a hook shape at the bottom of the upper component and removably hooked around and under the inside of the bar tacking at the bottom of the opening to the pants pocket. This metal bar extends upwardly through the upper component of this invention and is fastened to a typical trucker's wallet chain at the top end of the upper component of this invention. The other end of the trucker's wallet chain is fastened to the pants belt in the same manner as the connection on a real trucker's wallet chain. In additional detail the lower component of this invention consists of one or more objects of an appropriate shape, size and material positioned in front of or behind the handgun barrel or in front of and behind the handgun barrel to hide and camouflage the outline and shape of the lower end of the handgun barrel.

In use the handgun is carried in the pants pocket with the barrel vertical or angled to put the muzzle to the rear and the lower holster component in the bottom of the pants pocket and the upper holster component protruding from the pants pocket opening. To draw the handgun the wearer merely pushes in on the bottom end of the metal bar which causes the hook to release from around the bar tacking and the upper holster component then falls away allowing the wearer to simply pull the handgun out of the pocket very quickly.

Accordingly, it is an object of this invention to provide an improved handgun concealment holster, a holster that completely conceals a handgun on a person, a holster that completely conceals a large handgun in the pants pocket of a person and a holster that is very comfortable to wear as in carrying almost anything in a person's pants pocket. An additional object of this invention is to provide a handgun concealment holster that does not require a shirt or coat or even long pants legs for concealment of the handgun.

The preferred embodiments of this invention will become apparent by a study of the following discussion.

DESCRIPTION OF THE PREFERRED EMBODIMENTS

Figure 1:
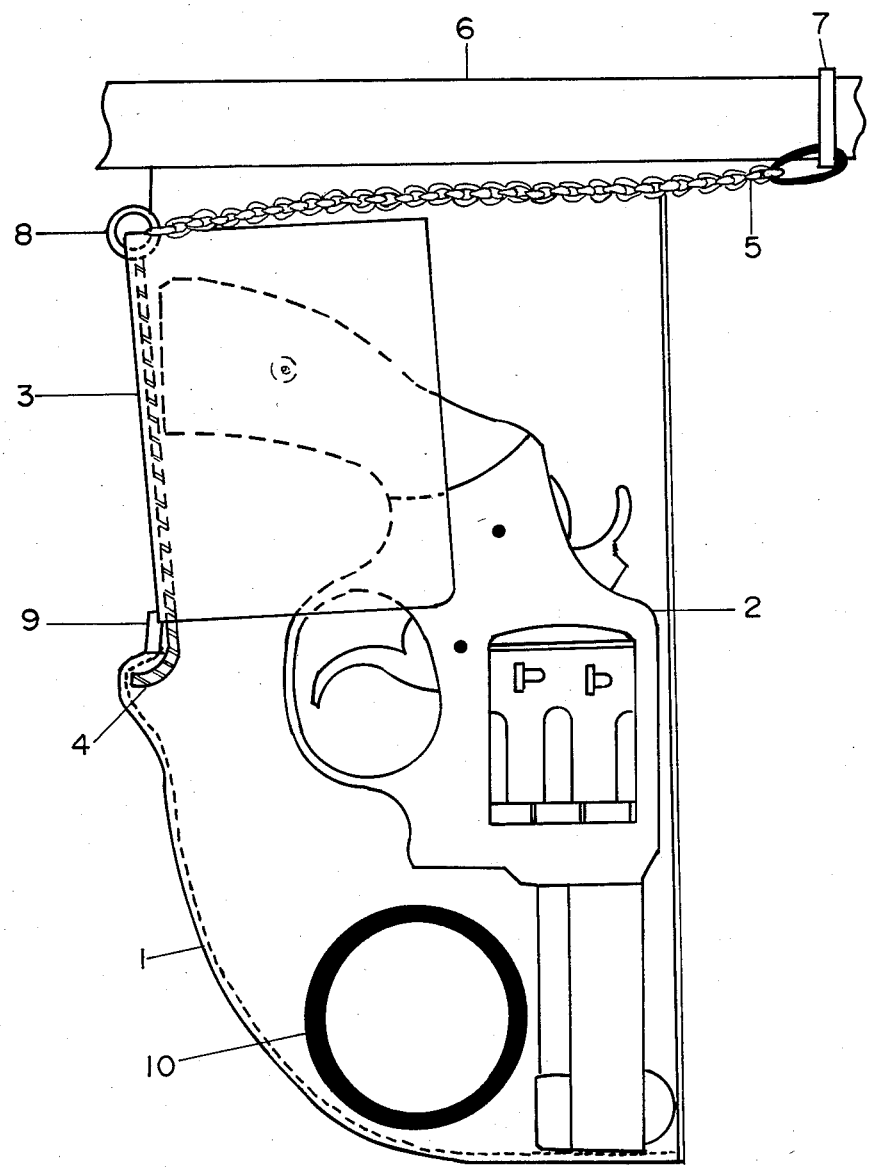
FIG. 1. is a front right pants pocket with the outer pants cloth removed and the outer pocket material removed for a direct view of the handgun and holster in the pants pocket. All numbered parts in FIG. 1. carry the same numbers in all figures.
Figure 2:
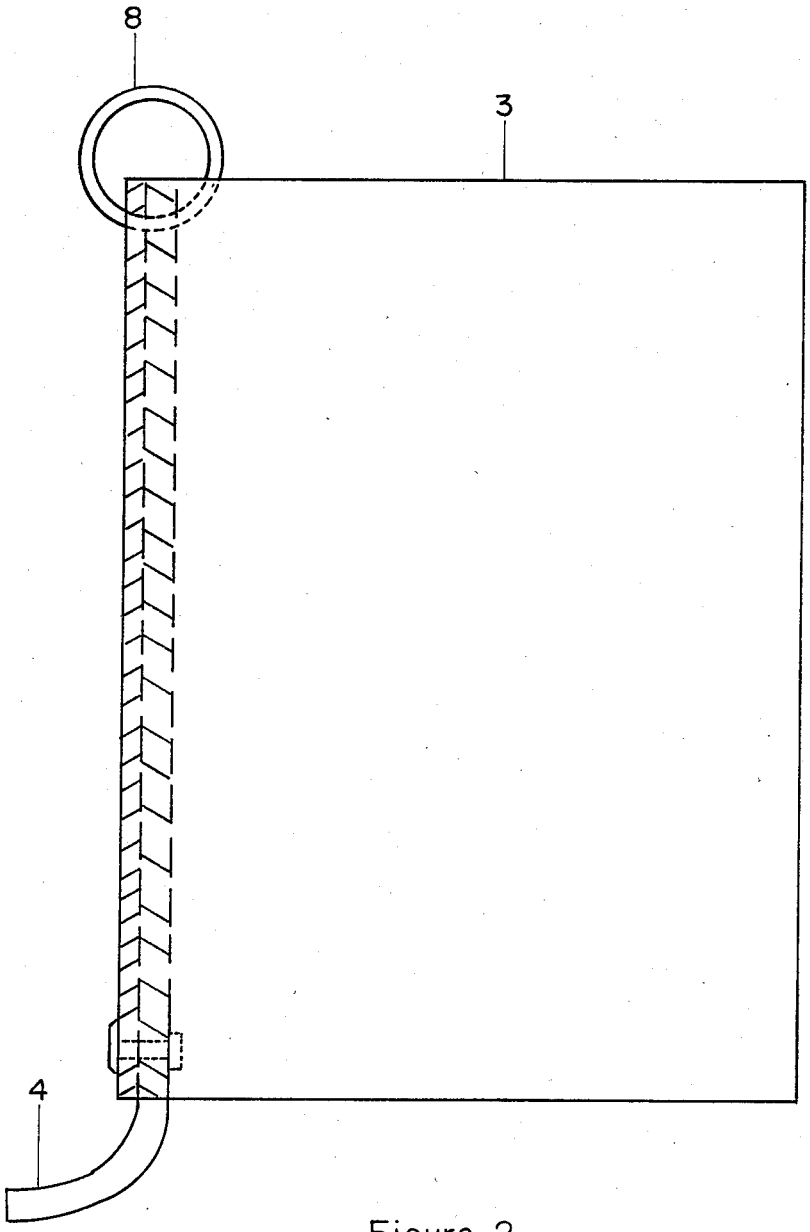
FIG. 2. is a more detailed view of the use of the metal bar 4. in the upper component of this invention.
Figure 3:
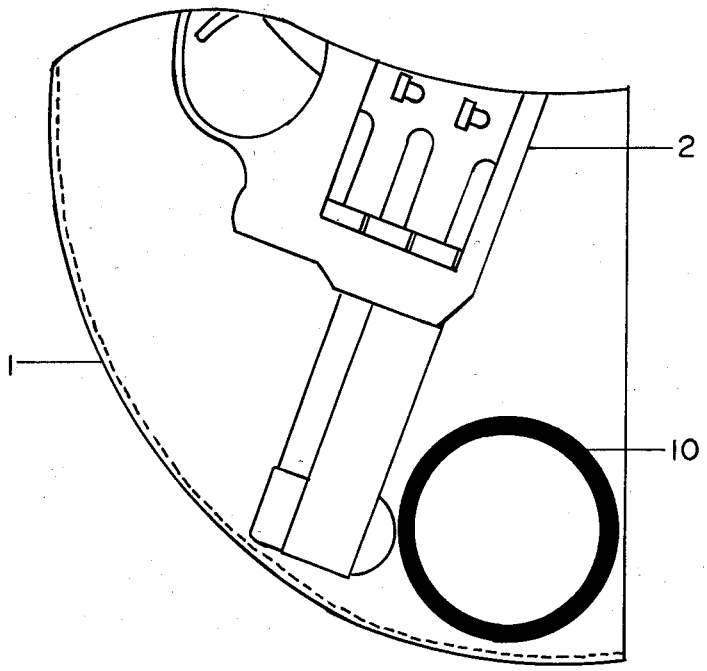
FIG. 3. is an additional view of the lower half of FIG. 1. showing the short piece of plastic pipe 10. in front of the handgun barrel.

The front right pants pocket 1. is used to carry the handgun 2. A piece of leather, leatherette, vinal or similar appearing material 3. is formed like a pouch around the grip of the handgun to conceal the said grip and to appear like the upper part of a large trucker's wallet.

The leather pouch 3. is held in place by rivets to the metal bar 4. placed vertically inside the leather pouch 3. The lower end of the metal bar 4. is bent especially to hook inside the pocket 1. under and around inside the bar tacking 9. located at the bottom of the normal opening to the pocket 1. to secure the lower end of the metal bar 4. and leather pouch 3. The upper end of the metal bar 4. stays just inside the leather pouch 3. out of sight and is fastened to the said leather pouch 3. and a strong decorative chain 5. by a strong decorative ring 8. or a rivet. The other end of the said chain 5. is fastened to the belt loop 7. or better still around the waist belt 6. beyond the belt loop 7. to secure the said chain 5. and upper end of the metal bar 4. While secured top and bottom the metal bar 4. positions the leather pouch 3. around the said handgun grip and secures the handgun 2. within the pocket 1.

A short piece of plastic pipe 10. serves to break up the outline and shape of the lower part of the handgun 2. in the pocket 1.

The drawing FIG. 1. shows a right front pants pocket, however, this same holster works equally well in the left front pants pocket, simply by reversing the holster.

While details of this invention have been shown and described, this invention is not limited to the above and is intended to cover all changes and modifications that fall within the spirit and scope of this invention.

I claim:

1. A concealment holster for a handgun which is held in the opening of a front pants pocket designed to appear as a truckers wallet, said holster including two generally flat side surfaces joined by a rounded side portion defining a pouch sized to fit about the grip handle of said handgun, the pouch being joined at the upper end and having a configuration which appears to be a truckers wallet, a metal bar inserted vertically in said pouch, the metal bar being fastened to said rounded side portion and including a hook at the lower end of the metal bar and a wallet chain mounted to said bar at the upper end of the pouch, and shaping means for placement in the pants pocket for conforming the pocket to substantially conceal and camouflage the shape of the lower end of the handgun.

2. A holster as in claim 1 with the said shaping means formed by one appropriatly shaped object with a sufficient thickness to transfer the outline of the handgun out to the larger outline of the said object in front of the handgun barrel in order to conceal and camouflage the shape of the lower end of the handgun.

* * * * *